US007931219B2

(12) United States Patent
Eriksson et al.

(10) Patent No.: US 7,931,219 B2
(45) Date of Patent: Apr. 26, 2011

(54) ANTI-SPIN ASSEMBLY

(75) Inventors: Bengt-Arne Eriksson, Svedala (SE); Johan Gunnarsson, Sövde (SE); Percy Norrman, Höör (SE)

(73) Assignee: Sandvik Intellectual Property AB, Sandviken (SE)

( * ) Notice: Subject to any disclaimer, the term of this patent is extended or adjusted under 35 U.S.C. 154(b) by 61 days.

(21) Appl. No.: 12/453,543

(22) Filed: May 14, 2009

(65) Prior Publication Data

US 2009/0283616 A1 Nov. 19, 2009

(30) Foreign Application Priority Data

May 15, 2008 (SE) ..... 0801100

(51) Int. Cl.
*B02C 2/02* (2006.01)

(52) U.S. Cl. ..... 241/30; 241/207

(58) Field of Classification Search ..... 241/207–216, 241/30

See application file for complete search history.

(56) References Cited

U.S. PATENT DOCUMENTS

| | | | | |
|---|---|---|---|---|
| 3,743,193 | A | 7/1973 | DeDiemar et al. | |
| 3,887,143 | A | 6/1975 | Gilbert et al. | |
| 4,206,881 | A * | 6/1980 | Werginz | 241/207 |
| 5,931,394 | A * | 8/1999 | Haven et al. | 241/30 |

FOREIGN PATENT DOCUMENTS

| | | |
|---|---|---|
| WO | 99/22869 | 5/1999 |
| WO | 01/28689 | 4/2001 |

* cited by examiner

*Primary Examiner* — Mark Rosenbaum

(74) *Attorney, Agent, or Firm* — Drinker Biddle & Reath LLP

(57) ABSTRACT

An anti-spin assembly is arranged in a gyratory crusher. The anti-spin assembly includes an expandable braking receptacle, which is adapted to be expanded by way of a pressure medium. The braking receptacle is arranged in a space between a first surface formed on a part which rotates with the crushing head and a second surface formed on a non-rotary part which is connected to the frame bottom part. The braking receptacle is arranged, when expanding, to engage both the first and the second surface, thereby braking the rotation of the crushing head.

10 Claims, 2 Drawing Sheets

ANTI-SPIN ASSEMBLY

CROSS-REFERENCE TO PRIOR APPLICATION

This application claims priority to Swedish Application No. 0801100-9 filed May 15, 2008, which is incorporated by reference herein.

FIELD OF THE INVENTION

The present invention relates to an anti-spin assembly in a gyratory crusher, which includes a crushing head, on which an inner shell is mounted, and a frame with a frame top part, on which an outer shell is mounted, and a frame bottom part, on which a shaft supporting the crushing head is arranged, the outer shell defining together with the inner shell a crushing gap and an eccentric arranged about the shaft being adapted to cause the crushing head to execute a gyratory pendulum movement with a view to crushing material that is introduced in the crushing gap.

BACKGROUND OF THE INVENTION

When material to be crushed is introduced in the crushing gap of a gyratory crusher of the type stated by way of introduction, the material causes the inner shell and, thereby, the crushing head to rotate in the direction opposite to the direction of rotation of the eccentric. On the other hand, when no material is supplied the crushing head starts to rotate in the same direction as the eccentric. When the crusher is to be shifted from idle-running to crushing, the rotation of the crushing head must first be decelerated to zero speed and then accelerated for rotation in the opposite direction. This results in considerable wear to the crushing shells. Moreover, the crushing head may reach such a speed, as it co-rotates with the eccentric, that the material to be crushed is thrown out of the crushing gap when new material is being fed to the crusher, which may be hazardous for the operator. To remedy the above problems gyratory crushers are provided with anti-spin assemblies which are adapted to prevent or brake, in different ways, the co-rotation of the crushing head with the eccentric.

Various anti-spin assemblies for gyratory crushers are known in the art.

U.S. Pat. No. 3,887,143 discloses an anti-spin assembly which is arranged at the lower part of the crusher shaft. A hydraulic pump is attached to the anti-spin assembly. A displaceable universal drive shaft extends through the shaft and is connected at its upper portion to a universal joint, which in turn is connected to the crushing head mount. The lower end of the shaft is connected to the internal rotary mechanism of the pump through a coupling. During a no-feed condition when the crushing head starts to rotate with the eccentric in the direction of rotation of the latter, the rotary mechanism of the pump is bypassed to allow only very slow rotation of the shaft and the crushing head. According to that disclosure, the co-rotation of the crushing head with the eccentric is restrained to such an extent by the pump that the shell is not damaged.

U.S. Pat. No. 3,743,193 discloses a hydraulic motor, which is disposed inside the crushing head for rotating the crushing head at the same speed as the eccentric, but in the opposite direction. The result is that the crushing head is essentially stationary at zero load.

WO 01/28689 discloses an anti-rotation and sealing system for a gyratory crusher. A seal is provided between the lower portion of the crushing head and a fixed frame. At its upper end the seal is tightened into the crushing head and rotates with the same. At its lower end the seal is tightened into a clamp element with a plate that is pressed against a surface of the fixed frame by way of a plurality of springs. The purpose of the springs is to provide enough friction between the plate and the surface to prevent the crushing head from rotating when the crushing chamber is empty, while allowing the head to rotate slowly when material is present in the chamber. This is a relatively complex construction, and one that brakes in both directions.

OBJECTS AND SUMMARY OF THE INVENTION

The object of the present invention is to provide a simple and robust anti-spin assembly, which makes it possible to brake the rotation of the crushing head. A further object is to provide a method of braking the rotation of a crushing head in a gyratory crusher and a gyratory crusher provided with an anti-spin assembly.

This object is achieved, as far as the anti-spin assembly is concerned, by an anti-spin assembly in a gyratory crusher of the kind described above, which assembly includes at least one expandable braking receptacle, which is expandable by way of a pressure medium and which is arranged in a space between a first surface formed on a part which rotates with the crushing head and a second surface formed on a non-rotary part which is connected to the frame, the braking receptacle being arranged, when expanding, to engage both the first and the second surface, thereby braking the rotation of the crushing head. This design enables straightforward activation and control of the braking of the crushing head.

The braking receptacle is preferably attached to the second surface. In this embodiment, the anti-spin assembly does not rotate, which allows a simpler design as far as the provision of supply pipes for the pressure medium is concerned. However, it is also possible to attach the braking receptacle to the first surface.

According to a preferred embodiment, the braking receptacle is annular and encircles the shaft. In this embodiment, some part of the annular braking receptacle will always be in contact with some portion of the first surface of the rotating part during braking, despite the gyrating movement of the crushing head.

Suitably, the first surface is an inner circumferential surface of a protective skirt arranged on the crushing head as a downward extension of the crushing head and the second surface is a non-rotary part arranged inside the protective skirt.

The pressure medium supplied to the braking receptacle is suitably hydraulic fluid, preferably hydraulic oil, or compressed air.

The object is further achieved, as far as the method is concerned, by a method of braking a crushing head of a gyratory crusher of the kind mentioned above by way of an anti-spin assembly, which includes an expandable braking receptacle, which is expanded by way of a pressure medium and which is arranged in a space between a first surface of a part which rotates with the crushing head and second surface of a non-rotary part which is connected to the frame bottom part, in which method the braking receptacle, when expanding, engages both the first and the second surface for braking the rotation of the crushing head.

The braking receptacle is suitably expanded in the absence of material in the crushing gap. According to a preferred embodiment of the invention, the braking receptacle is expanded when the power consumption of the crusher or the load on the crushing head is lower than a predetermined threshold value as a way of detecting that the crusher is idling and that no material to be crushed is fed to it.

BRIEF DESCRIPTION OF THE DRAWINGS

The invention will be described in more detail below by way of a preferred, but not limiting embodiment and with reference to the accompanying drawings.

DETAILED DESCRIPTION OF THE PREFERRED EMBODIMENTS

Figure 1:
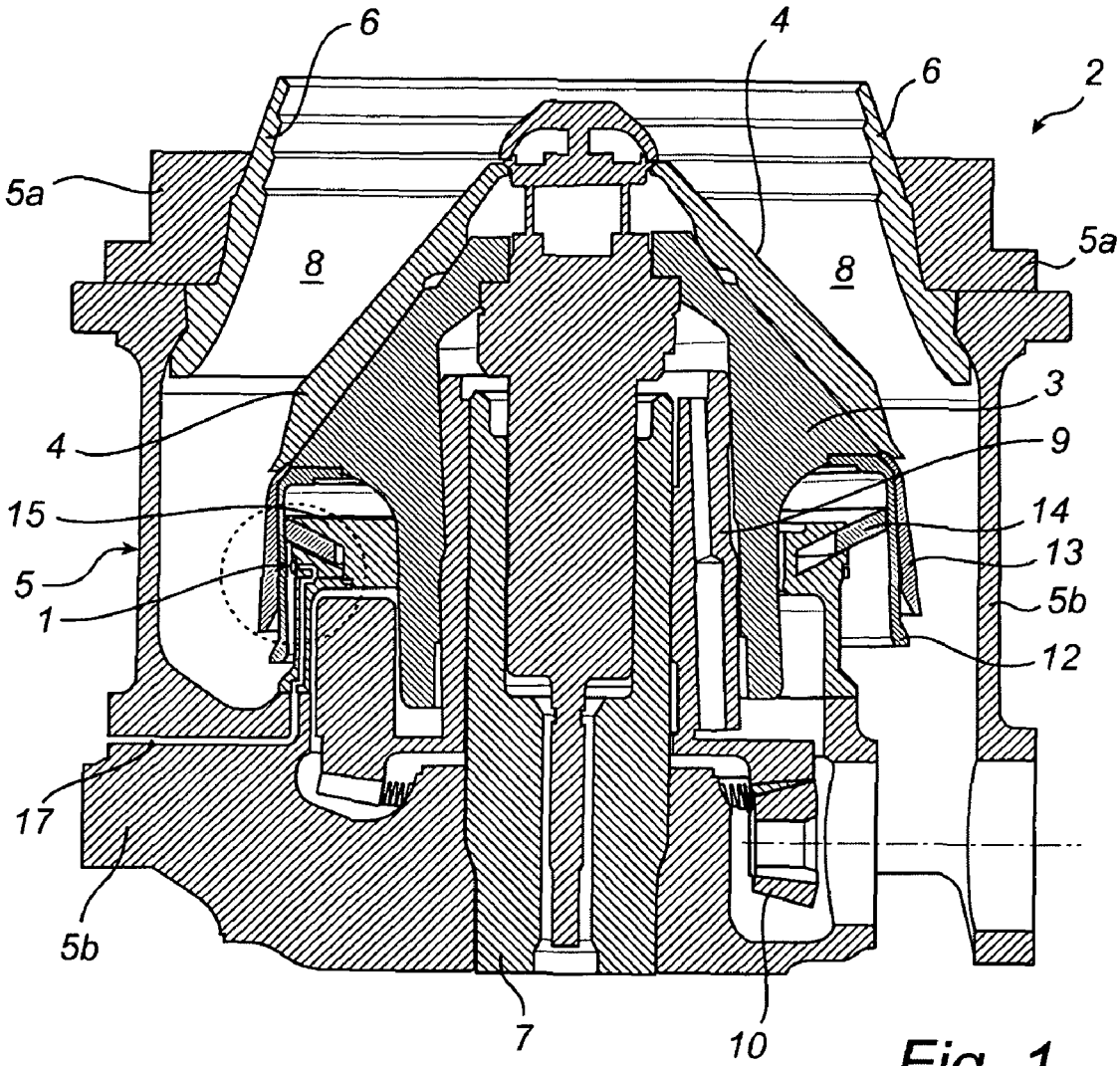
FIG. 1 is a cross-sectional view of a gyratory crusher.

FIG. 1 shows an anti-spin assembly 1 according to the invention, which is intended for a gyratory crusher 2. Such a crusher 2 includes, as shown in FIG. 1, a crushing head 3 on which an inner shell 4 is mounted. The crusher 2 further includes a frame 5 with a frame top part 5*a*, on which an outer shell 6 is mounted, and a frame bottom part 5*b*, on which a shaft 7 supporting the crushing head 3 is arranged. The shaft 7 is fixedly mounted in the frame bottom part 5*b* and is thus a non-rotary shaft.

The outer shell 6 defines together with the inner shell 4 a crushing gap 8. An eccentric 9 arranged about the shaft 7 is adapted to cause the crushing head 3 to execute a gyratory pendulum movement with a view to crushing material that is introduced in the crushing gap 8. FIG. 1 illustrates schematically a gear train 10, which transmits a movement to the eccentric 9 from a horizontal drive shaft (not shown), which is driven by a motor.

Suspended from the crushing head 3, as a downward extension of the inner shell 4, is a substantially cylindrical, first protective skirt 12 of metal, which is adapted to prevent components, such as bearings, situated below the crushing head 3 from being damaged by crushed material. Outside the protective skirt is a second protective skirt 13 made of rubber, which is adapted to reduce the wear to the first protective skirt 12. Inside the protective skirts 12, 13 a circumferential dust-proof seal 14 is arranged in a groove in a holder 15, which is fixedly connected to the frame bottom part 5*b*. The dust-proof seal 14 abuts against the inner surface of the first protective skirt 12 to prevent crushed material from penetrating under the protective skirts 12, 13.

The anti-spin assembly 1 is adapted to prevent the crushing head 3 from rotating with the eccentric 9 when no material is introduced in the crushing gap 8. The purpose of the anti-spin assembly 1 is to reduce the wear and the accident hazard that are associated with this co-rotation, also known as spinning. In particular in mobile crushing mills, where there is no continuous feeding of material to be crushed to the crusher, the need for an anti-spin assembly is considerable.

Figure 2A:
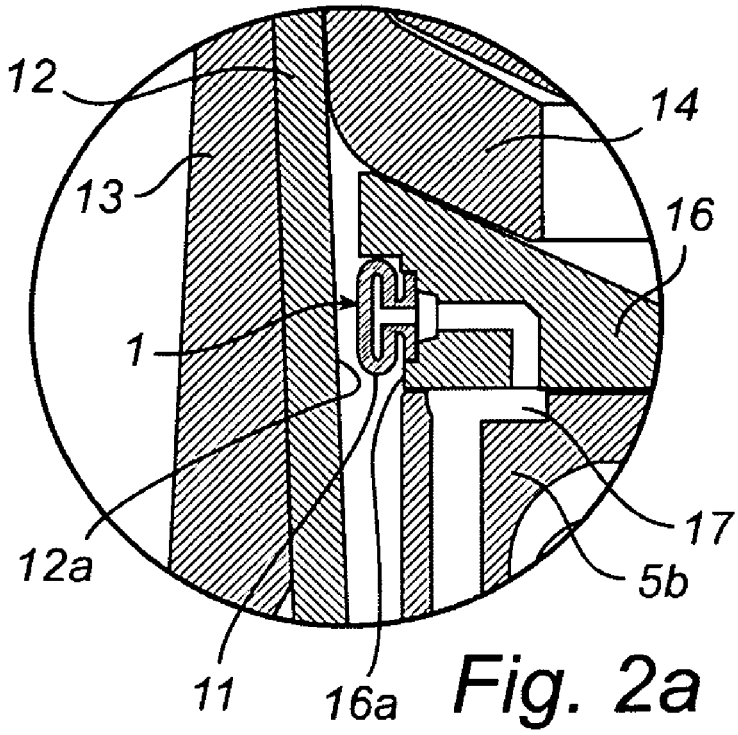
FIG. 2*a* is a cross-sectional view, in enlarged scale, of a part of the crusher in FIG. 1 and, in particular, of an anti-spin assembly.
Figure 2B:
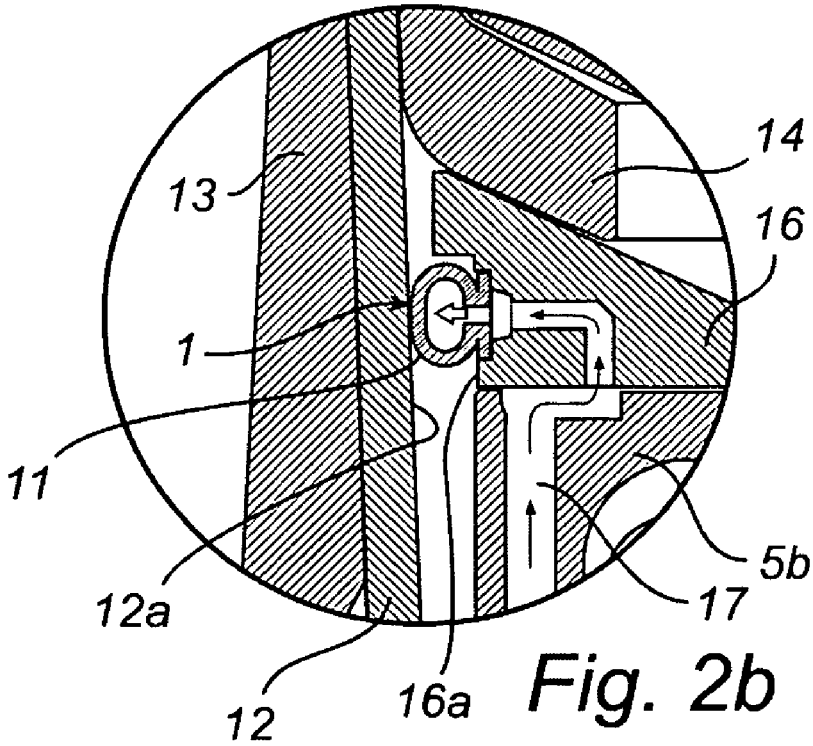
FIG. 2*b* is the same view as that of FIG. 2*a*, but with the anti-spin assembly in a braking state.

FIG. 2*a* and FIG. 2*b* show the anti-spin assembly 1 in more detail. The anti-spin assembly includes an expandable braking receptacle 11, which can be expanded by way of a pressure medium. In the present case, the braking receptacle 11 is in the form of a tube made of rubber. The pressure medium is suitably a hydraulic fluid, such as hydraulic oil, or a pressurized gas, such as compressed air. The anti-spin assembly 1 is arranged in a space between a first surface 12*a* of a part 12 which rotates with the crushing head 3 and second surface 16*a* of a non-rotary part 16 which is fixedly connected to the frame bottom part 5*b*.

The first surface 12*a* is an inner circumferential surface of the first protective skirt 12 and the second surface 16*a* is a non-rotary block 16 which is arranged inside this protective skirt 12 and fixedly connected to the frame bottom part 5*b* and the holder 15 for the dust-proof seal 14. In the embodiment shown, the first and the second surface consist of two vertical surfaces 12*a*, 16*a*, but depending on the crusher design also two horizontal surfaces, or two oblique surfaces, may form the space for the braking receptacle.

The braking receptacle 11 is annular and encircles the shaft 7. A supply pipe 17 conducts the pressure medium to the braking receptacle 11 from a source of pressure medium (not shown) via the frame bottom part 5*b* and the block 16. Instead of an annular braking receptacle 11, several separate braking receptacles may be arranged in the space between the first and the second surface. In this case, each braking receptacle is provided with a separate supply pipe.

In the method of braking a crushing head 3 of a gyratory crusher 2 of the type described above by way of an anti-spin assembly 1 according to the invention, the braking receptacle 11 is expanded by a pressure medium, so that it is brought into engagement with both the first and the second surface 12*a* and 16*a*.

FIG. 2 shows the anti-spin assembly in a state where a material to be crushed is supplied to the crusher. In this state, the braking receptacle 11 is substantially contracted and is not affected by the rotation of the crushing head 3. Accordingly, the anti-spin assembly 1 will not be subjected to wear when the crusher performs crushing work.

FIG. 3 shows the braking receptacle 11 in the braking state of the anti-spin assembly 1. The braking receptacle 11 is expanded and, thus, in contact with both the first and the second surface 12*a* and 16*a* in such a manner that the rotation of the crushing head 3 is braked by the friction between the first surface 12*a* and the braking receptacle 11.

The braking receptacle 11 is arranged to be expanded when there is no material in the crushing gap, i.e. during idle-running. The expansion of the braking receptacle 11 can be activated in various ways. Idling may be detected by measuring the power consumption of the crusher 2 or the compressive load on the crushing head 3, in which case a predetermined threshold value, which is individual for each crusher, indicates idling and, therefore, that the anti-spin assembly should be activated. It is also conceivable to detect the lack of material to be crushed by way of the equipment, such as belt conveyors, which feeds the material to the crusher.

The anti-spin assembly described above may also be used for other types of gyratory crushers than the type described above. It may, for example be used for the type of gyratory crushers which have a rotary shaft journalled in bearings in a frame top part, for instance a crusher of the general type disclosed in WO 99/22869.

The invention can be modified in various ways within the scope of the appended claims. There are, for example, alternative positions in which an anti-spin assembly can be disposed on a crusher depending on the type of crusher and the crusher design. The shape and size of the braking receptacle are dependent on its location and the need for braking. The anti-spin assembly may include one or more braking receptacles. The expansion of the braking receptacle may be easily controlled on the basis of different parameters, for instance considering the crusher environment.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. An anti-spin assembly in a gyratory crusher, comprising:

a crushing head;

an inner shell is mounted on said crushing head;

a frame with a frame top part and a frame bottom part;

an outer shell mounted on said frame top part;

a shaft supporting the crushing head, said shaft being arranged on said frame bottom part, the outer shell defining together with the inner shell a crushing gap; and an eccentric arranged about the shaft being adapted to cause the crushing head to execute a gyratory pendulum movement with a view to crushing material that is introduced in the crushing gap;

wherein the anti-spin assembly includes at least one expandable braking receptacle, which is adapted to be expanded by way of a pressure medium and which is arranged in a space between a first surface formed on a part which rotates with the crushing head and a second surface formed on a non-rotary part which is connected to the frame, the at least one expandable braking receptacle being arranged, when expanding, to engage both the first and the second surface, thereby braking the rotation of the crushing head.

2. The anti-spin assembly according to claim 1, wherein the at least one expandable braking receptacle is attached to the second surface.

3. The anti-spin assembly according to claim 1, wherein the at least one expandable braking receptacle is annular and encircles the shaft.

4. The anti-spin assembly according to claim 1, wherein the first surface is an inner circumferential surface of a protective skirt arranged on the crushing head as a downward extension of the inner shell and the second surface is a non-rotary part arranged inside the protective skirt.

5. The anti-spin assembly according to claim 1, wherein the pressure medium is hydraulic fluid or compressed air.

6. The anti-spin assembly according to claim 1, wherein the at least one expandable braking receptacle is arranged to be expanded in the absence of material in the crushing gap.

7. A gyratory crusher with an anti-spin assembly according to claim 1.

8. A method of braking a crushing head of a gyratory crusher, comprising:

providing a crushing head, on which an inner shell is mounted, and a frame with a frame top part, on which an outer shell is mounted, and a frame bottom part, on which a shaft supporting the crushing head is arranged, the outer shell defining together with the inner shell a crushing gap and an eccentric arranged about the shaft being adapted to cause the crushing head to execute a gyratory pendulum movement with a view to crushing material that is introduced in the crushing gap;

using at least one anti-spin assembly which comprises an expandable braking receptacle, which is expandable by way of a pressure medium and arranged in a space between a first surface formed on a part which rotates with the crushing head and a second surface formed on a non-rotary part which is connected to the frame; and arranging the braking receptacle, when expanding, to engage both the first and the second surface and to brake the rotation of the crushing head.

9. The method according to claim 8, wherein the braking receptacle is expanded in the absence of material in the crushing gap.

10. The method according to claim 8, wherein the braking receptacle is expanded when the power consumption of the crusher or the load on the crushing head is lower than a predetermined threshold value.

* * * * *